US010914137B2

(12) United States Patent
Vincent

(10) Patent No.: US 10,914,137 B2
(45) Date of Patent: Feb. 9, 2021

(54) DOWNHOLE PUMP FOR WELLBORE CLEANOUTS

(71) Applicant: Ray Vincent, Williston, ND (US)

(72) Inventor: Ray Vincent, Williston, ND (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 82 days.

(21) Appl. No.: 16/432,412

(22) Filed: Jun. 5, 2019

(65) Prior Publication Data

US 2020/0386075 A1 Dec. 10, 2020

(51) Int. Cl.
*E21B 37/00* (2006.01)
*E21B 37/02* (2006.01)

(52) U.S. Cl.
CPC ..... *E21B 37/02* (2013.01); *E21B 37/00* (2013.01)

(58) Field of Classification Search
CPC ..... E21B 37/00; E21B 37/02; E21B 27/00; E21B 27/005; E21B 43/126
See application file for complete search history.

(56) References Cited

U.S. PATENT DOCUMENTS

| | | | | |
|---|---|---|---|---|
| 2,890,756 | A * | 6/1959 | Middleton | E21B 27/00 166/99 |
| 4,091,631 | A * | 5/1978 | Cherrington | E21B 7/046 175/62 |
| 5,447,200 | A | 9/1995 | Dedora et al. | |
| 6,745,839 | B1 | 6/2004 | Simpson | |
| 8,978,752 | B2 | 3/2015 | Dobson et al. | |
| 2012/0118571 | A1 | 5/2012 | Zhou | |
| 2012/0273278 | A1 | 11/2012 | Zhu | |

OTHER PUBLICATIONS

International Search Report and Written Opinion for International Application No. PCT/US2020/035061; International Filing Date May 29, 2020; Report dated Sep. 10, 2020 (pp. 1-8).

* cited by examiner

*Primary Examiner* — Brad Harcourt
(74) *Attorney, Agent, or Firm* — Cantor Colburn LLP

(57) ABSTRACT

A wellbore cleanout system including a first tubular, and a pump member including a stator and a rotor. The stator has a first end, a second end, an outer surface, and an inner surface defining an internal passage. The rotor is arranged within the internal passage and includes a first end portion connected to the first tubular and a second end portion. The rotor is coupled for rotation with the first tubular. A drag system including at least one drag member is fixedly mounted to the outer surface of the stator. A second tubular is connected to the second end of the rotor. The second tubular is coupled for rotation with the first tubular.

17 Claims, 3 Drawing Sheets

DOWNHOLE PUMP FOR WELLBORE CLEANOUTS

BACKGROUND

In the resource recovery industry, it is often desirable to clean out debris from a wellbore to promote flow of production fluids. In some wellbores, sand may accumulate and inhibit production flow. For example, in instances where low bottom hole pressure (BHP) exists, sand may accumulate at a heel portion or toe portion of the wellbore. The accumulation of sand at the heel portion or toe portion creates a flow restriction that limits the passage of production fluids to a surface system.

In order to remove the accumulated sand, fluid is circulated into the wellbore. Unfortunately, in wellbores having a low BHP, circulated fluid may be lost to the formation. Fluid loss to the formation limits the circulation needed to clear the accumulated sand or other debris. Accordingly, the industry would welcome a wellbore cleanout system for low BHP wellbores that does not require fluid introduction and circulation.

SUMMARY

Disclosed is a wellbore cleanout system including a first tubular, and a pump member including a stator and a rotor. The stator has a first end, a second end, an outer surface, and an inner surface defining an internal passage. The rotor is arranged within the internal passage and includes a first end portion connected to the first tubular and a second end portion. The rotor is coupled for rotation with the first tubular. A drag system including at least one drag member is fixedly mounted to the outer surface of the stator. A second tubular is connected to the second end of the rotor. The second tubular is coupled for rotation with the first tubular.

Also disclosed is a resource exploration and recovery system including a first system and a second system including a tubular string fluidically connected to the first system. The tubular string supports a wellbore cleanout system including a first tubular, and a pump member including a stator and a rotor. The stator has a first end, a second end, an outer surface, and an inner surface defining an internal passage. The rotor is arranged within the internal passage and includes a first end portion connected to the first tubular and a second end portion. The rotor is coupled for rotation with the first tubular. A drag system including at least one drag member is fixedly mounted to the outer surface of the stator. A second tubular is connected to the second end of the rotor. The second tubular is coupled for rotation with the first tubular.

Further discloses is a method of cleaning out a wellbore including introducing tubular supporting a pump member including a stator and a rotor into the wellbore, locking the stator to an inner wall of the wellbore, rotating the rotor to create a pumping force, and drawing wellbore fluids into the pump member through an inlet tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
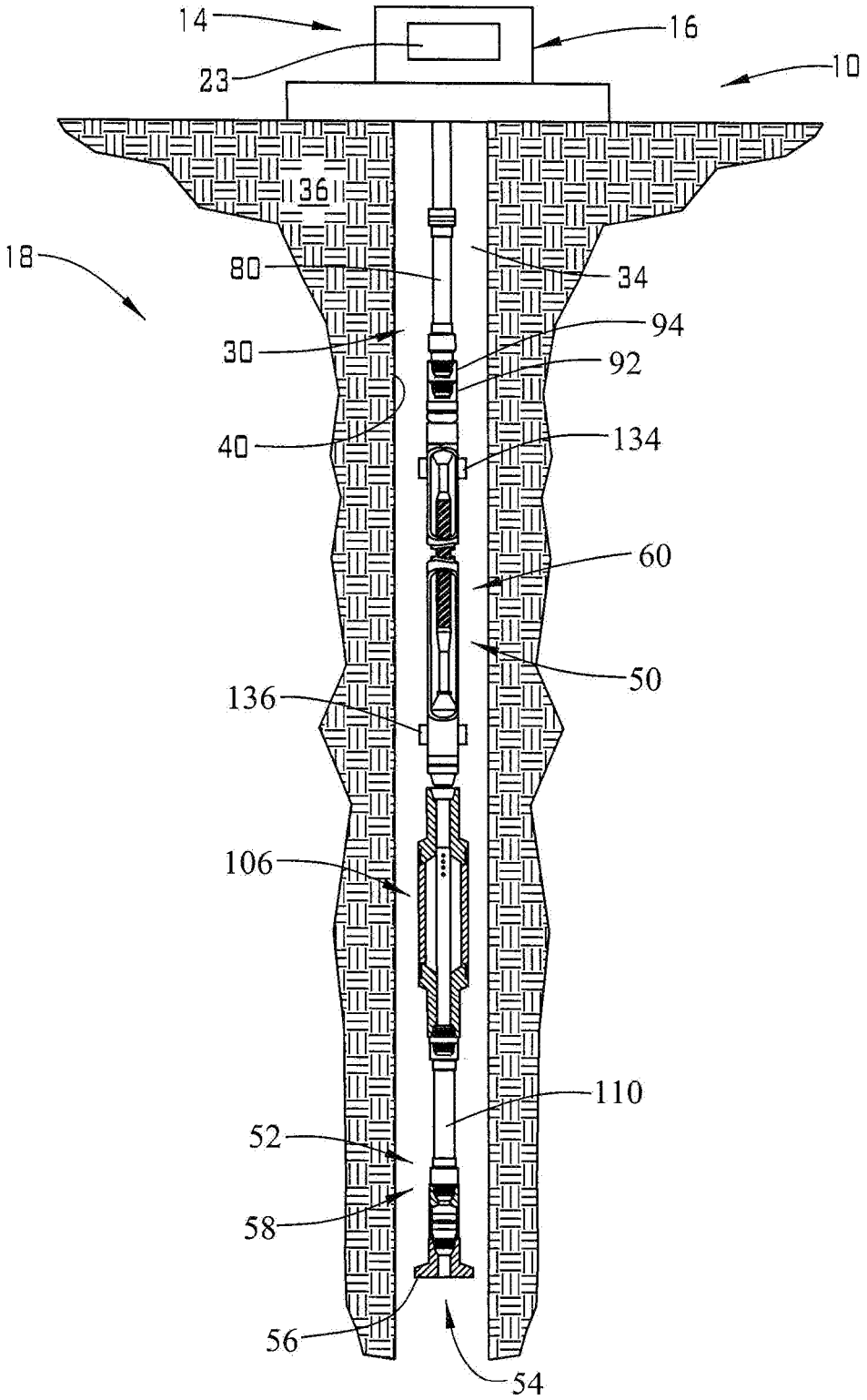
FIG. 1 depicts a partial cross-sectional view of a resource exploration and recovery system including a wellbore cleanout system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 40 which may be defined by a surface of formation 36. Of course, it should be understood, that wellbore 34 may include a casing tubular (not shown).

Tubular string 30 supports a wellbore cleanout system 50 connected to a bottom hole assembly (BHA) 52. BHA 52 may include disintegrating tool 54. Disintegrating tool 54 may take the form of a completion bit 56 coupled to tubular string 30 via a basked flutter cage 58. Of course, it should be understood that disintegrating tool 54 may take on other forms including a mill bit or the like.

Figure 2A:
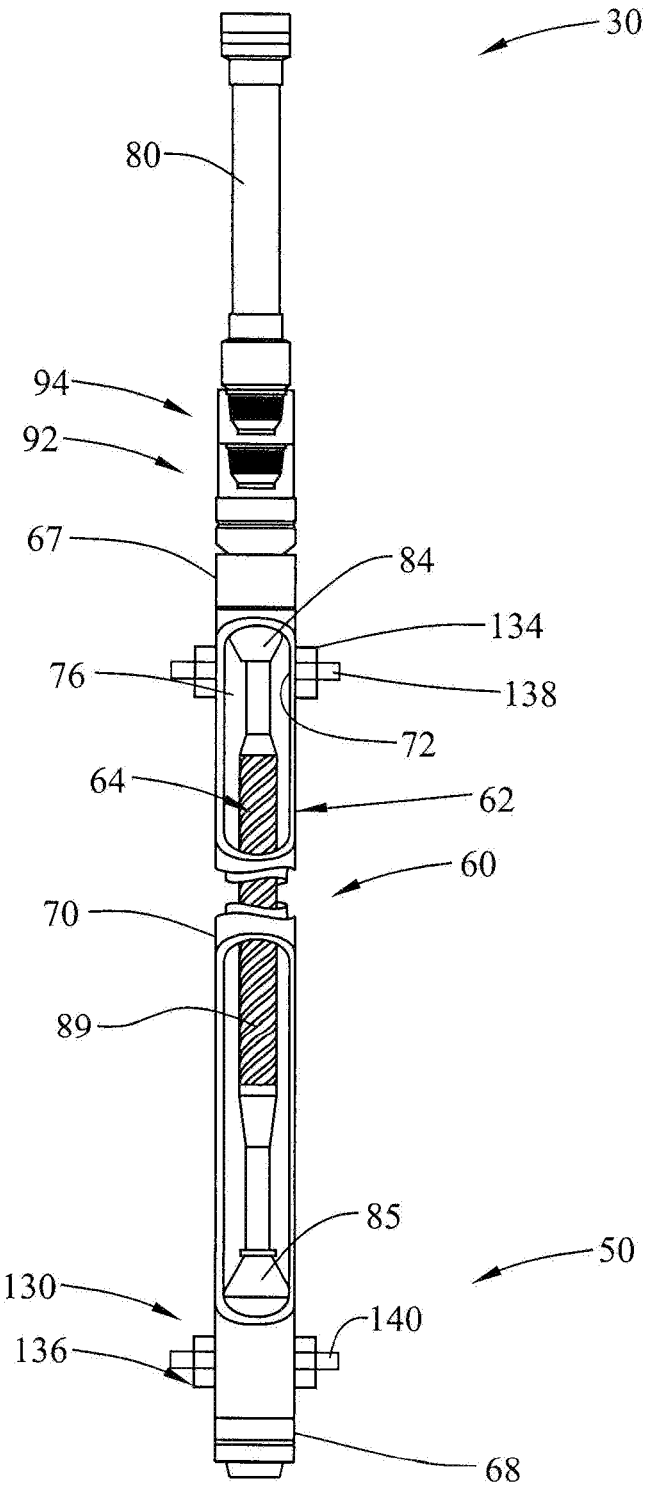
FIG. 2A depicts a first portion of the wellbore cleanout system of FIG. 1, in accordance with an exemplary embodiment.
Figure 2B:
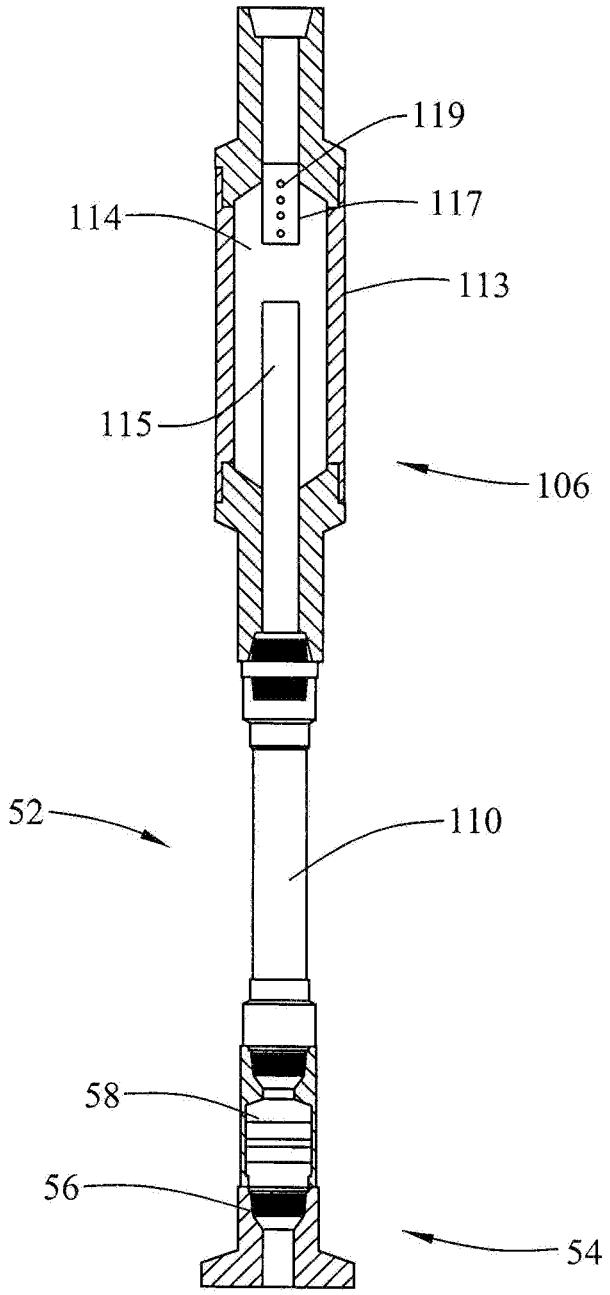
FIG. 2B depicts a second portion of the wellbore cleanout system of FIG. 1, in accordance with an exemplary embodiment.

Referring to FIGS. 2A and 2B, wellbore cleanout system 50 includes a pump member 60 that is operated, through rotation of tubular string 30, to draw in sediment, debris and the like along with fluid positioned in wellbore 34. In an exemplary aspect, pump member 60 includes a stator 62 and a rotor 64. Stator 62 includes a first end 67, a second end 68, an outer surface 70 and an inner surface 72. Inner surface 72 defines an interior passage 76. Rotor 64 is operatively connected to a tubular 80 that forms part of tubular string 30.

More specifically, rotor 64 includes a first end portion 84 connected to tubular 80, a second end portion 85, and an intermediate portion (not separately labeled) including a plurality of lobes 89. Inner surface 72 of stator 62 may also include lobes (also not separately labeled). In an embodiment, pump member 60 defines a progressive cavity pump that may operate based on the Moineau principle. As such, lobes on inner surface 72 may outnumber lobes 89 on rotor 64. Rotor 64 may be connected to tubular 80 through a fluid drain sub 92 that distributes fluid passing through pump member 60 back into wellbore 34 and a kill/drain sub 94.

In an embodiment, second end portion 85 of rotor 64 is connected to a debris catcher 106. Debris catcher 106 is connected to BHA 52 through another tubular 110 that may take the form of a wash or tail pipe (not separately labeled). Debris catcher 106 includes an outer housing 113 having an interior 114. An inlet 115 extends into interior 114 from tubular 110. An outlet 117 extends into interior 114 from pump member 60. Outlet 117 may include a screen 119.

In accordance with an exemplary embodiment, wellbore cleanout system 50 includes a drag system 130 that, as will be detailed herein, locks rotation of stator 62 to annular wall 38 of wellbore 34. More specifically, drag system 130 includes a first drag member 134 fixedly connected to outer surface 70 proximate to first end 67 and a second drag member 136 fixedly connected to outer surface 70 proximate to second end 68. First drag member 134 may include a first radially outwardly expanding portion 138. Similarly, second drag member 136 may include a radially outwardly expanding portion 140. Radially outwardly expanding portions 138 and 140 may expand out and engage with annular wall 38.

In an embodiment, tubular string 30 is introduced into wellbore 34. Disintegrating tool 54 is run-in to a desired position. At this point, radially outwardly expanding portions 138 and 140 are activated to engage with annular wall 38 thereby preventing rotation of stator 62. Tubular string 30 may be rotated to impart a rotational force to disintegrating tool 54 and rotor 64. Rotation of rotor 64 within stator 62 results in a suction causing fluid and debris to pass into tubular 110 and flow into debris catch 106. Debris entrained in the fluid is trapped in interior 114 while fluid flows through outlet 117 and into pump member 60. Fluid may be returned to wellbore 34 via fluid drain sub 92.

At this point, it should be understood that exemplary embodiments describe a wellbore cleanout system that includes a pump to provide lift to fluids in the wellbore. The fluids pass through a debris catch thereby reducing any accumulated debris at portions of the wellbore. The use of the pump avoids the need to circulates fluids into the wellbore and therefore is particularly advantageous in formations having a low bottom hole pressure (BHP).

Set forth below are some embodiments of the foregoing disclosure:

Embodiment 1. A wellbore cleanout system comprising: a first tubular; a pump member including a stator and a rotor, the stator having a first end, a second end, an outer surface, and an inner surface defining an internal passage, the rotor being arranged within the internal passage and includes a first end portion connected to the first tubular and a second end portion, the rotor being coupled for rotation with the first tubular; a drag system including at least one drag member fixedly mounted to the outer surface of the stator; and a second tubular connected to the second end of the rotor, the second tubular being coupled for rotation with the first tubular.

Embodiment 2. The wellbore cleanout system according to any prior embodiment, wherein the at least one drag member includes a first drag member arranged on the outer surface adjacent the first end and a second drag member arranged on the outer surface adjacent the second end.

Embodiment 3. The wellbore cleanout system according to any prior embodiment, further comprising: a debris catch operatively connected between the rotor and the second tubular.

Embodiment 4. The wellbore cleanout system according to any prior embodiment, wherein the debris catch is fluidically connected to the internal passage of the stator.

Embodiment 5. The wellbore cleanout system according to any prior embodiment, further comprising: a degrading tool coupled to the second tubular.

Embodiment 6. The wellbore cleanout system according to any prior embodiment, wherein the degrading tool includes one of a mill bit and a completion bit.

Embodiment 7. The wellbore cleanout system according to any prior embodiment, wherein the pump member comprises a progressive cavity pump.

Embodiment 8. A resource exploration and recovery system comprising: a first system; a second system including a tubular string fluidically connected to the first system, the tubular string supporting a wellbore cleanout system comprising: a first tubular; a pump member including a stator and a rotor, the stator having a first end, a second end, an outer surface, and an inner surface defining an internal passage, the rotor being arranged within the internal passage and includes a first end portion connected to the first tubular and a second end portion, the rotor being coupled for rotation with the first tubular; a drag system including at least one drag member fixedly mounted to the outer surface of the stator; and a second tubular connected to the second end of the rotor, the second tubular being coupled for rotation with the first tubular.

Embodiment 9. The resource exploration and recovery system according to any prior embodiment, wherein the at least one drag member includes a first drag member arranged on the outer surface adjacent the first end and a second drag member arranged on the outer surface adjacent the second end.

Embodiment 10. The resource exploration and recovery system according to any prior embodiment, further comprising: a debris catch operatively connected between the rotor and the second tubular.

Embodiment 11. The resource exploration and recovery system according to any prior embodiment, wherein the debris catch is fluidically connected to the internal passage of the stator.

Embodiment 12. The resource exploration and recovery system according to any prior embodiment, further comprising: a degrading tool coupled to the second tubular.

Embodiment 13. The resource exploration and recovery system according to any prior embodiment, wherein the degrading tool includes one of a mill bit and a completion bit.

Embodiment 14. The resource exploration and recovery system according to any prior embodiment, wherein the pump member comprises a progressive cavity pump.

Embodiment 15. A method of cleaning out a wellbore comprising: introducing tubular supporting a pump member including a stator and a rotor into the wellbore; locking the stator to an inner wall of the wellbore; rotating the rotor to create a pumping force; and drawing wellbore fluids into the pump member through an inlet tubular.

Embodiment 16. The method according to any prior embodiment, wherein locking the stator to the inner wall includes radially outwardly expanding a drag member mounted to an outer surface of the stator.

Embodiment 17. The method according to any prior embodiment, further comprising: passing the fluid through a debris catch arranged between the inlet tubular and the pump member.

Embodiment 18. The method according to any prior embodiment, further comprising: discharging the fluid from the tubular uphole of the pump member.

Embodiment 19. The method according to any prior embodiment, wherein drawing wellbore fluids into the pump includes introducing wellbore fluids through a degrading tool.

Embodiment 20. The method according to any prior embodiment, wherein introducing the tubular supporting the pump member includes directing a progressive cavity pump member into the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A wellbore cleanout system comprising:

a first tubular;

a pump member including a stator and a rotor, the stator having a first end, a second end, an outer surface, and an inner surface defining an internal passage, the rotor being arranged within the internal passage and includes a first end portion connected to the first tubular and a second end portion, the rotor being coupled for rotation with the first tubular;

a drag system including a first drag member arranged on the outer surface adjacent the first end and a second drag member arranged on the outer surface adjacent the second end; and a second tubular connected to the second end of the rotor, the second tubular being coupled for rotation with the first tubular.

2. The wellbore cleanout system according to claim 1, further comprising: a debris catch operatively connected between the rotor and the second tubular.

3. The wellbore cleanout system according to claim 2, wherein the debris catch is fluidically connected to the internal passage of the stator.

4. The wellbore cleanout system according to claim 1, further comprising: a degrading tool coupled to the second tubular.

5. The wellbore cleanout system according to claim 4, wherein the degrading tool includes one of a mill bit and a completion bit.

6. The wellbore cleanout system according to claim 1, wherein the pump member comprises a progressive cavity pump.

7. A resource exploration and recovery system comprising:

a first system;

a second system including a tubular string fluidically connected to the first system, the tubular string supporting a wellbore cleanout system comprising:

a first tubular;

a pump member including a stator and a rotor, the stator having a first end, a second end, an outer surface, and an inner surface defining an internal passage, the rotor being arranged within the internal passage and includes a first end portion connected to the first tubular and a second end portion, the rotor being coupled for rotation with the first tubular;

a drag system including a first drag member arranged on the outer surface adjacent the first end and a second drag member arranged on the outer surface adjacent the second end; and a second tubular connected to the second end of the rotor, the second tubular being coupled for rotation with the first tubular.

8. The resource exploration and recovery system according to claim 7, further comprising: a debris catch operatively connected between the rotor and the second tubular.

9. The resource exploration and recovery system according to claim 8, wherein the debris catch is fluidically connected to the internal passage of the stator.

10. The resource exploration and recovery system according to claim 7, further comprising: a degrading tool coupled to the second tubular.

11. The resource exploration and recovery system according to claim 10, wherein the degrading tool includes one of a mill bit and a completion bit.

12. The resource exploration and recovery system according to claim 7, wherein the pump member comprises a progressive cavity pump.

13. A method of cleaning out a wellbore comprising:

introducing tubular supporting a pump member including a stator and a rotor into the wellbore;

locking the stator to an inner wall of the wellbore by radially outwardly expanding a first drag member coupled to a first end of the stator and a second drag member coupled to a second end of the stator;

rotating the rotor to create a pumping force; and drawing wellbore fluids into the pump member through an inlet tubular.

14. The method of claim 13, further comprising: passing the fluid through a debris catch arranged between the inlet tubular and the pump member.

15. The method of claim 13, further comprising: discharging the fluid from the tubular uphole of the pump member.

16. The method of claim 13, wherein drawing wellbore fluids into the pump includes introducing wellbore fluids through a degrading tool.

17. The method of claim 13, wherein introducing the tubular supporting the pump member includes directing a progressive cavity pump member into the wellbore.

* * * * *